US008690636B2

(12) United States Patent
Oshima

(10) Patent No.: US 8,690,636 B2
(45) Date of Patent: Apr. 8, 2014

(54) COMPOUND SEMICONDUCTOR SUBSTRATE PRODUCTION METHOD

(75) Inventor: Yuichi Oshima, Tsuchiura (JP)

(73) Assignee: Hitachi Cable, Ltd., Tokyo (JP)

( * ) Notice: Subject to any disclaimer, the term of this patent is extended or adjusted under 35 U.S.C. 154(b) by 1055 days.

(21) Appl. No.: 12/659,765

(22) Filed: Mar. 19, 2010

(65) Prior Publication Data

US 2010/0300423 A1 Dec. 2, 2010

(30) Foreign Application Priority Data

May 26, 2009 (JP) ..... 2009-126357

(51) Int. Cl.
*B24B 1/00* (2006.01)

(52) U.S. Cl.
USPC ..... 451/7; 125/21; 451/41

(58) Field of Classification Search
USPC ..... 451/41; 125/21
See application file for complete search history.

(56) References Cited

U.S. PATENT DOCUMENTS

| | | | | |
|---|---|---|---|---|
| 8,056,551 | B2 * | 11/2011 | Dalitz et al. | 125/16.02 |
| 8,168,516 | B2 * | 5/2012 | Ueno | 438/483 |
| 8,222,119 | B2 * | 7/2012 | Henley | 438/459 |
| 8,268,643 | B2 * | 9/2012 | Matsumoto | 438/14 |
| 2008/0188011 | A1 * | 8/2008 | Henley | 438/5 |
| 2010/0170495 | A1 * | 7/2010 | Dalitz et al. | 125/21 |

FOREIGN PATENT DOCUMENTS

| | | | |
|---|---|---|---|
| JP | 2007197240 A | * | 8/2007 |
| JP | 2008-188721 | | 8/2008 |
| JP | 2008188721 A | * | 8/2008 |

* cited by examiner

*Primary Examiner* — Maurina Rachuba
(74) *Attorney, Agent, or Firm* — McGinn Intellectual Property Law Group, PLLC

(57) ABSTRACT

A method of making a compound semiconductor substrate includes providing a GaN compound semiconductor single crystal ingot, and cutting the ingot with a cutter to form a GaN single crystal substrate. The cutting is performed while controlling a temperature in a contact portion between the ingot and the cutter to be not more than 160° C. such that a cut surface of the GaN single crystal substrate has an arithmetical mean waviness (Wa) not more than 9 μm.

13 Claims, 7 Drawing Sheets

COMPOUND SEMICONDUCTOR SUBSTRATE PRODUCTION METHOD

The present application is based on Japanese patent application No. 2009-126357 filed on May 26, 2009, the entire contents of which are incorporated herein by reference.

BACKGROUND OF THE INVENTION

1. Field of the Invention

The present invention relates to a method for producing a compound semiconductor substrate. In particular, it relates to a method for producing a compound semiconductor substrate, involving cutting a compound semiconductor substrate.

2. Description of the Related Art

As a method for producing a single crystal substrate from a compound semiconductor single crystal ingot such as a gallium nitride (GaN), aluminum nitride (AlN), silicon carbide (SiC), and the like, there is known a substrate production method, that includes preparing a not less than 150 mmϕ diameter and not less than 300 mm long ingot, and cutting the ingot by pressing against a moving wire, wherein in the cutting step, the wire feeding speed is made faster in only a central portion in a diametrical direction of the ingot than at the beginning of cutting and near the end of cutting.

Since the above substrate production method makes the wire feeding speed faster in the central portion of the ingot, the wire wear is lessened, and the wire wobble can be reduced, and the bend of the cut surface of the resulting substrate can be made small.

Refer to JP-A-2008-188721, for example.

However, in the above substrate production method, when from an economical viewpoint, increasing the cutting speed of slicing a very hard compound semiconductor such as GaN, the roughness of the cut surface of the resulting substrate may be increased, or the damage to the crystal surface due to cutting may be significant.

SUMMARY OF THE INVENTION

Accordingly, it is an object of the present invention to provide a compound semiconductor substrate production method, capable of producing a high precision compound semiconductor single crystal substrate.

(1) According to one embodiment of the invention, a method of making a compound semiconductor substrate comprises:

providing a GaN compound semiconductor single crystal ingot; and cutting the ingot with a cutter to form a GaN single crystal substrate, wherein the cutting is performed while controlling a temperature in a contact portion between the ingot and the cutter to be not more than 160° C.

In the above embodiment (1), the following modifications and changes can be made.

(i) A cut surface of said GaN single crystal substrate has an arithmetical mean waviness (Wa) not more than 9 μm.

(2) According to another embodiment of the invention, a method of making a compound semiconductor substrate comprises:

providing an AlN compound semiconductor single crystal ingot; and cutting the ingot with a cutter to form an AlN single crystal substrate, wherein the cutting is performed while controlling a temperature in a contact portion between the ingot and the cutter to be not more than 200° C.

In the above embodiment (2), the following modifications and changes can be made.

(ii) A cut surface of said AlN single crystal substrate has an arithmetical mean waviness (Wa) not more than 9 μm.

(3) According to another embodiment of the invention, a method of making a compound semiconductor substrate comprises:

providing a SiC compound semiconductor single crystal ingot; and cutting the ingot with a cutter to form a SiC single crystal substrate, wherein the cutting is performed while controlling a temperature in a contact portion between the ingot and the cutter to be not more than 240° C.

In the above embodiment (3), the following modifications and changes can be made.

(iii) A cut surface of said SiC single crystal substrate has an arithmetical mean waviness (Wa) not more than 18 μm.

Points of the Invention

According to one embodiment of the invention, a compound semiconductor substrate production method controls a contact portion between a cutter (saw wires) and a compound semiconductor single crystal ingot at an appropriate temperature so as to suppress a decrease in thermal conductivity of the compound semiconductor single crystal to efficiently dissipate the frictional heat produced during cutting the ingot. This allows the ingot to be suppressed from being thermally expanded/contracted during the cutting so as to decrease a variation in arithmetical mean waviness (Wa) in cut surface of the compound semiconductor single crystal substrate during the cutting. It is therefore possible to improve the roughness (unevenness) of the cut surface of the compound semiconductor single crystal substrate resulting from the ingot, and to realize its high-precision and high-speed cutting.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

First Embodiment

Figure 1:
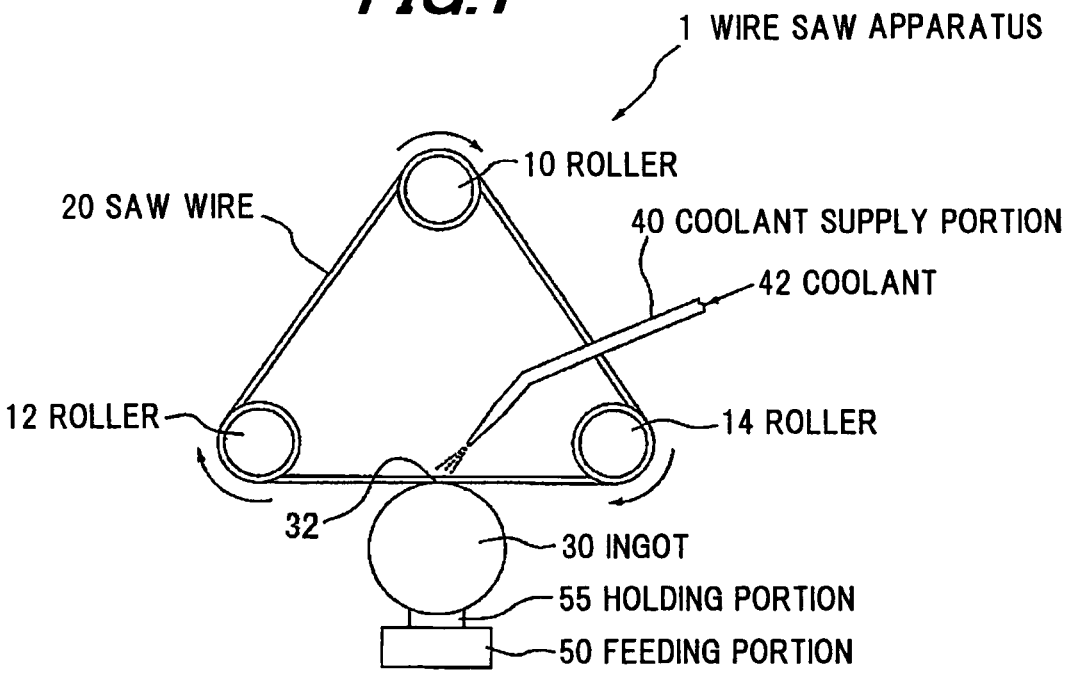
FIG. 1 is a schematic diagram showing a wire saw apparatus to be used for compound semiconductor substrate production in a first embodiment.

FIG. 1 schematically shows a wire saw apparatus to be used for compound semiconductor substrate production in a first embodiment of the invention.

A compound semiconductor substrate production method in the first embodiment is for fabricating a GaN single crystal substrate from a GaN single crystal ingot 30 to be used as a compound semiconductor. The GaN single crystal substrate is produced by using a wire saw apparatus 1 cutting the ingot 30 with its cut portion being cooled.

Wire Saw Apparatus 1

The wire saw apparatus 1 comprises a roller 10 for reciprocating saw wires 20 to be used as a cutting member in a specified direction and at a specified speed, a roller 12, a roller 14, a holding portion 55 for holding a GaN ingot 30, a feeding portion 50 for continuously moving the holding portion 55 toward the saw wires 20, and a coolant supply portion 40 for supplying a coolant 42 for cooling at least a contact portion 32 between the saw wires 20 and the ingot 30 to the contact portion 32. The coolant 42 is circulated at a specified circulation speed in a temperature control system not shown, and is held at a predetermined temperature according to a kind of the ingot 30.

GaN Single Crystal Production Method

First, a GaN single crystal ingot 30 is prepared (Ingot preparing step). Next, the ingot 30 is held in the holding portion 55 of the wire saw apparatus 1 (Holding step). Subsequently, the saw wires 20 is operated at a specified speed along the roller 12 to the roller 14. The feeding portion 50 is then operated, to cause the ingot 30 to approach the saw wires 20 at a specified feeding speed. In this case, the coolant supply portion 40 blasts a coolant 42 cooled at a specified temperature toward the contact portion 32 between the saw wires 20 and the ingot 30. When abrasive grains are not being adhered to the surface of the saw wires 20, the coolant 42 may use a slurry containing abrasive grains. On the other hand, when abrasive grains are being adhered to the surface of the saw wires 20, the coolant 42 may be an aqueous coolant.

The ingot 30 is then cut with the saw wires 20, to form a GaN single crystal substrate (Cutting step). Here, in the cutting step, the specified temperature of the coolant 42 is set to facilitate the frictional heat dissipation due to the contact between the saw wires 20 and the ingot 30, and thereby inhibit the thermal expansion of the ingot 30. Specifically, in the first embodiment, the coolant 42 is set at a temperature possible to control the contact portion 32 at a temperature not more than 160° C., preferably not more than 140° C. This can reduce arithmetical mean wavinesses (Wa) in cut surface of the GaN single crystal substrate due to the frictional heat caused by the contact between the saw wires 20 and the ingot 30. Specifically, in the first embodiment, when cutting, i.e. slicing the ingot 30 with the saw wires 20, the contact portion 32 is held at a temperature not more than the specified temperature, thereby enhancing the thermal conductivity of the GaN single crystal, and facilitating the frictional heat dissipation due to the contact between the saw wires 20 and the ingot 30, therefore inhibiting the thermal expansion of the ingot 30, and the GaN wafer during the cutting.

Inventor's Findings

The compound semiconductor substrate production method in the first embodiment is the method by controlling the contact portion 32 at a temperature not more than the specified temperature according to a kind of the ingot 30. The inventor has found this method as follows.

Specifically, the wire saw apparatus 1 is for cutting an ingot 30 formed of a compound semiconductor single crystal by slowly pressing the ingot 30 against the saw wires 20 reciprocating at a high speed. In this case, since the ingot 30 and the saw wires 20 are rubbed at a high speed, significant frictional heat is produced in the contact portion 32. When the frictional heat is produced, the crystal adjacent to the contact portion 32 expands thermally. Here, the inventor has found that when the frictional heat is not dissipated immediately, the temperature of the contact portion 32 gradually varies (for example, gradually increases), and therefore the degree of the thermal expansion of the crystal cannot be controlled, which leads to a rough surface of the single crystal substrate resulting from its cutting, i.e. to its rough cut surface. Also, the inventor has found that when the temperature inside the ingot 30 is non-uniform resulting from the frictional heat, plural single crystal substrates cut out of the ingot 30 also cause significant variations in roughness in the cut surface for each single crystal substrate.

It is considered that, to dissipate the frictional heat in the contact portion 32, the contact portion 32 is cooled. For example, in the case of a free abrasive grain type cutting method by cutting the ingot 30 with a slurry containing abrasive grains supplied to the contact portion 32, the contact portion 32 is cooled by the slurry. Also, in the case of a fixed abrasive grain type cutting method by cutting the ingot 30 with the saw wires 20 with abrasive grains adhered to its surface, a coolant is supplied to the contact portion 32. Accordingly, the wire saw apparatus 1 in this embodiment is provided with the coolant supply portion 40 for supplying the coolant 42 controlled at the specified temperature to the contact portion 32.

Figure 2:
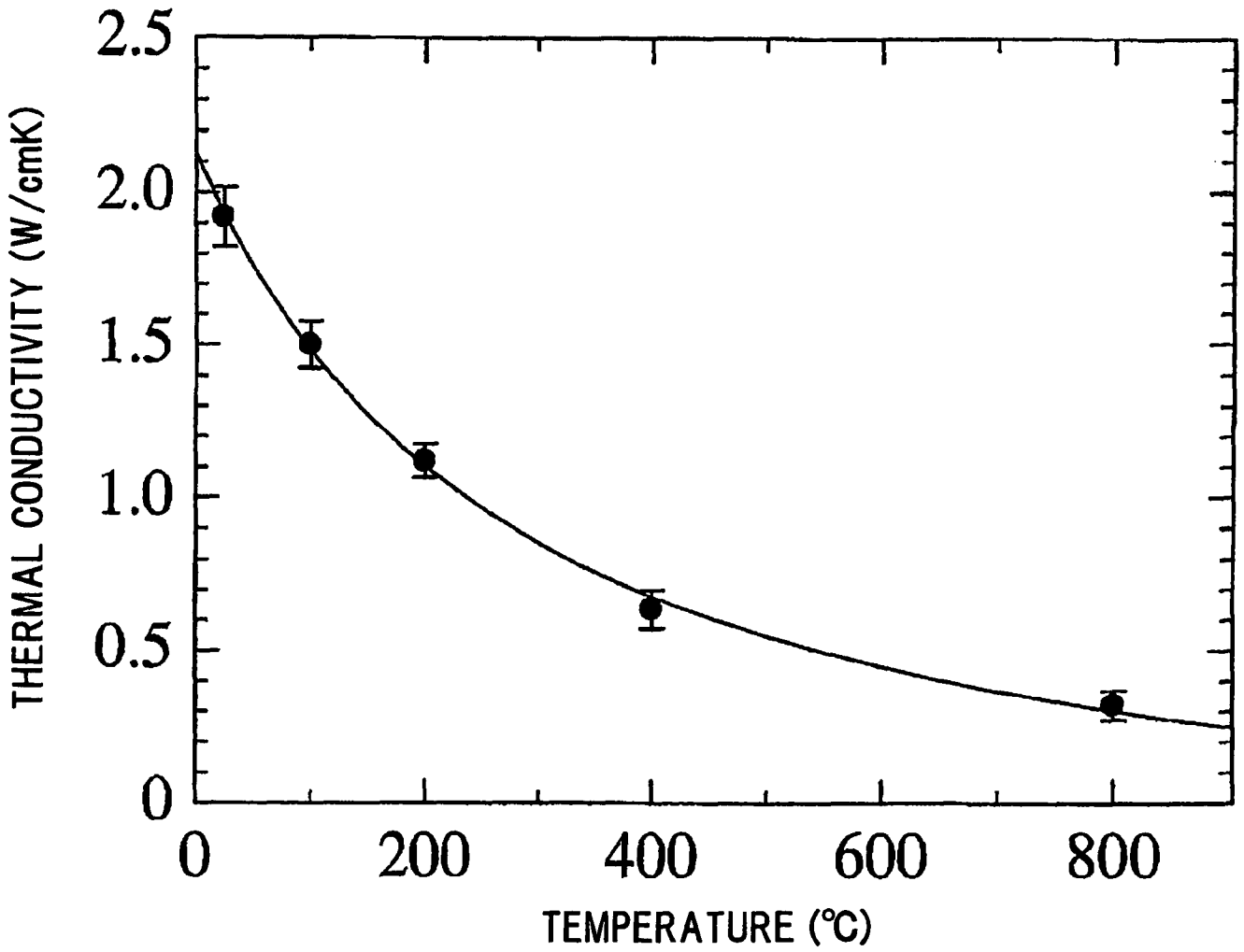
FIG. 2 is a diagram showing a temperature dependence of the thermal conductivity of a GaN single crystal.

Here, the inventor has focused on the thermal conductivities of compound semiconductors (i.e. GaN, AlN, and SiC). Referring to Table 1, the thermal conductivities at room temperature of the compound semiconductor crystals are very large, compared to the other compound semiconductors (e.g. GaAs, etc.). However, the thermal conductivities of the compound semiconductors are decreased with increasing temperature. For example, the temperature dependence of the thermal conductivity of a GaN single crystal is shown in FIG. 2. Herein, GaN, AlN, and SiC are referred to as high thermal conductivity compound semiconductors, and GaAs, ZnSe, GaP, and InP are referred to as low thermal conductivity compound semiconductors.

TABLE 1

| Compound semiconductor | Thermal conductivity (W/cmK) |
|---|---|
| GaN | 2.0 |
| AlN | 3.2 |
| SiC | 4.9 |
| GaAs | 0.54 |
| ZnSe | 0.18 |
| GaP | 0.77 |
| InP | 0.68 |

FIG. 2 shows a temperature dependence of the thermal conductivity of a GaN single crystal.

As seen from FIG. 2, the thermal conductivity of the GaN single crystal is decreased at 200° C. to approximately ½ the thermal conductivity at room temperature, and decreased at 800° C. to approximately ¼ the thermal conductivity at room temperature. Because the thermal conductivities of the other compound semiconductors exhibiting the low thermal conductivities, such as GaAs, GaP, etc., are also decreased with increasing temperature, the thermal conductivities of GaN, AlN, and SiC are large even at high temperatures such as 200° C., 800° C., etc., compared to GaAs, etc., but the differences between the thermal conductivities of the high and the low thermal conductivity compound semiconductors become small. Therefore, when the contact portion 32 is at high temperatures, no significant difference in the frictional heat dissipation is caused, regardless of kinds of the compound semiconductors for constituting the ingot 30 to cut. However, the inventor has found that the frictional heat can be dissipated properly, by decreasing the temperature of the contact portion 32, because the thermal conductivities of the high thermal conductivity compound semiconductors are thereby made very large.

Accordingly, the inventor has reached the fact that the frictional heat can be dissipated immediately, to inhibit variations of the thermal expansion of the crystal due to the frictional heat, by cooling the contact portion 32, and controlling the contact portion 32 at a temperature not more than the specified temperature according to kinds of the compound semiconductors for constituting the ingot 30.

Advantages of the First Embodiment

Since the compound semiconductor substrate production method in the first embodiment controls the contact portion 32 between the saw wires 20 and the GaN ingot 30 to be used as a compound semiconductor at an appropriate temperature (specifically, not more than 160° C.), the decrease of the thermal conductivity of the GaN single crystal can be inhibited, and the frictional heat produced during cutting the ingot 30 can thereby efficiently be dissipated. This allows the ingot 30 to be inhibited from being thermally expanded/contracted during the cutting, and the GaN single crystal substrate to be inhibited from varying in arithmetical mean waviness (Wa) in cut surface thereof during the cutting. It is therefore possible to decrease the roughness of the cut surface of the GaN single crystal substrate resulting from the ingot 30, and to realize its high-precision and high-speed cutting.

Also, since the compound semiconductor substrate production method in the first embodiment allows the decrease of the roughness of the cut surface, and the inhibition of the damage in the cut surface of the crystal, the amount to be removed by grinding of the surface after the slicing can be lessened, and the number of the single crystal substrates possible to be cut out of one ingot can be increased, and the time required for the subsequent grinding can also be shortened. Consequently, the compound semiconductor substrate production method in the first embodiment can provide the GaN single crystal substrate at low cost.

Second Embodiment

A compound semiconductor substrate production method in a second embodiment of the invention is for fabricating an aluminum nitride (AlN) single crystal substrate to be used as a compound semiconductor. The compound semiconductor substrate production method in the second embodiment is different from that of the first embodiment in that an ingot 30 to cut is formed of AlN. It includes the same steps of the first embodiment, except that its contact portion 32 is controlled at a temperature not more than 200° C. That is, in the second embodiment, in cutting the AlN ingot 30 with the wire saw apparatus 1, the contact portion 32 between the saw wires 20 and that AlN ingot 30 is controlled at a temperature not more than 200° C., preferably not more than 160° C. This can reduce arithmetical mean wavinesses (Wa) in cut surface of the AlN single crystal substrate due to the frictional heat caused by the contact between the saw wires 20 and the AlN ingot 30.

Third Embodiment

A compound semiconductor substrate production method in a third embodiment of the invention is for fabricating a silicon carbide (SiC) single crystal substrate to be used as a compound semiconductor. The compound semiconductor substrate production method in the third embodiment is different from that of the first embodiment in that an ingot 30 to cut is formed of SiC. It includes the same steps of the first embodiment, except that its contact portion 32 is controlled at a temperature not more than 240° C. That is, in the third embodiment, in cutting the SiC ingot 30 with the wire saw apparatus 1, the contact portion 32 between the saw wires 20 and that SiC ingot 30 is controlled at a temperature not more than 240° C., preferably not more than 200° C. This can reduce arithmetical mean wavinesses (Wa) in cut surface of the SiC single crystal substrate due to the frictional heat caused by the contact between the saw wires 20 and the SiC ingot 30.

Modification

Although the first to third embodiments are described with respect to only GaN, AlN, and SiC, the compound semiconductor substrate production methods in the first to third embodiments may also apply to high thermal conductivity/brittle materials. Also, the direction of slicing the ingot 30 may apply to any crystalline plane slicing, as well as slicing parallel to its c-plane.

Example 1

In Example 1, a GaN single crystal is fabricated from a GaN ingot. Specifically, a 50 mmϕ diameter and 10 mm thick GaN single crystal ingot 30, whose c-plane is taken as its principal surface, is sliced using a fixed abrasive grain type saw wires 20. Used as the saw wires 20 is a 250 μm wire diameter diamond electrodeposition saw wire. The ingot 30 is then sliced while blasting an aqueous coolant 42 controlled at a constant temperature toward the contact portion 32 between the saw wires 20 and the ingot 30. The aqueous coolant 42 may use a water-based coolant. Also, the wire moving speed of the saw wires 20 is set at 330 m/min, and its cutting speed (i.e. the feeding speed of the feeding portion 50) is set at 2 mm/h. This can result in 10 GaN wafers cut out being approximately 0.6 mm thick.

Here, the temperature of the coolant 42, the circulating speed of the coolant 42, and the position of blasting the coolant 42 to the ingot 30 are adjusted. The temperature of the contact portion 32 between the saw wires 20 and the ingot 30 is varied between from 100° C. to 220° C. The arithmetical mean wavinesses (Wa) in cut surface of the resulting GaN wafers after being cut out are compared. The arithmetical mean waviness (Wa) in cut surface is defined by JIS (Japanese Industrial Standards) B 0601:2001. The arithmetical mean wavinesses (Wa) are computed from data obtained by measuring a surface profile in cut surface of the resultant GaN wafers by using a laser displacement meter. The measurement conditions are as follows.

(1) Laser spot diameter of the laser displacement meter: 2 μm (2) Cutoff wavelength λ c: 0.08 mm (3) Profile filter wavelength λ f: 40 mm (4) Measured length: 5 mm (sampling length)×9 (cycles) =45 mm The measurement is conducted at 9 points in total, i.e., at the center of a GaN wafer and at eight points 5 mm, 10 mm, 15 mm and 20 mm, to the wafer outer edges, away from the center of the GaN wafer on a line passing through the center of the GaN wafer, while moving the laser in the direction (i.e., in the direction perpendicular to the direction of reciprocating the saw wires 20) of cutting the GaN wafer. Although the GaN wafer after cutting has two cut surfaces (i.e., front and rear surfaces thereof), the measurement results exhibit that the same arithmetical mean wavinesses (Wa) are obtained on both surfaces for each sample.

The temperature of the contact portion 32 is measured by burying a thermocouple adjacent to the contact portion 32 of the ingot 30. Also, the temperature of the contact portion 32 is controlled by adjusting the temperature of the coolant 42, the kind of the coolant 42, the blasting amount of the coolant 42, and the blasting position of the coolant 42.

Figure 3:
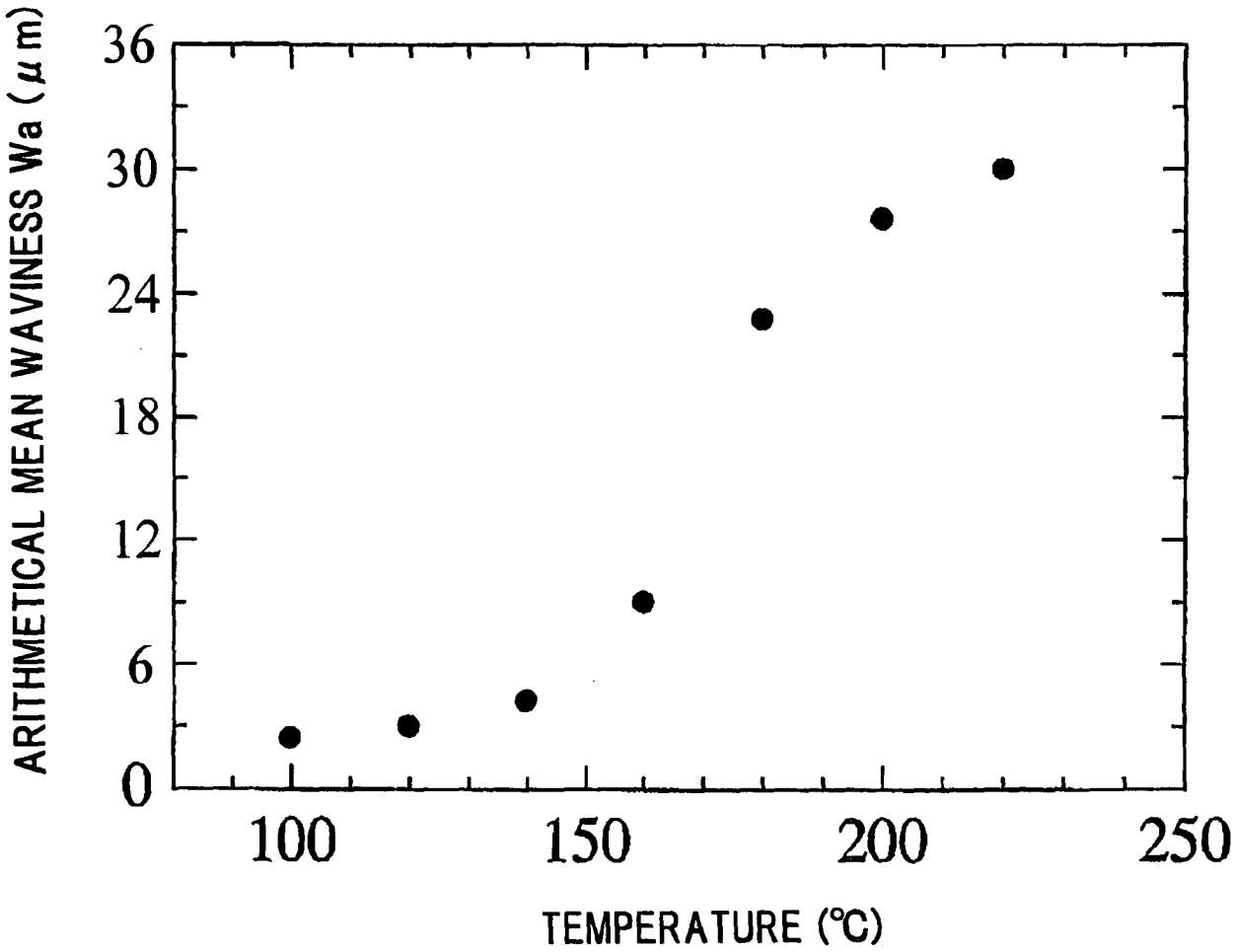
FIG. 3 is a diagram showing a relationship between arithmetical mean waviness (Wa) in cut surface of GaN wafer and contact portion temperature.

FIG. 3 shows a relationship between arithmetical mean waviness (Wa) in cut surface of GaN wafer and contact portion temperature.

The arithmetical mean wavinesses (Wa) in cut surface of the GaN wafer are decreased with decreasing temperature of the contact portion 32. Particularly, at a temperature of the contact portion 32 of not more than 180° C., the arithmetical mean waviness (Wa) begins being sharply decreased, and at a temperature of the contact portion 32 of not more than 160° C., the arithmetical mean waviness (Wa) is saturated at not more than 9 μm. That is, the temperatures not less than 100° C. and not more than 160° C. of the contact portion 32 result in the good arithmetical mean wavinesses (Wa) of not more than 9 μm. Also, the temperatures not more than 140° C. of the contact portion 32 result in the good arithmetical mean wavinesses (Wa) less than 6 μm.

As a comparison, on the other hand, the same experiment is implemented on a GaAs ingot, as in Example 1. The result is shown in FIG. 4.

Figure 4:
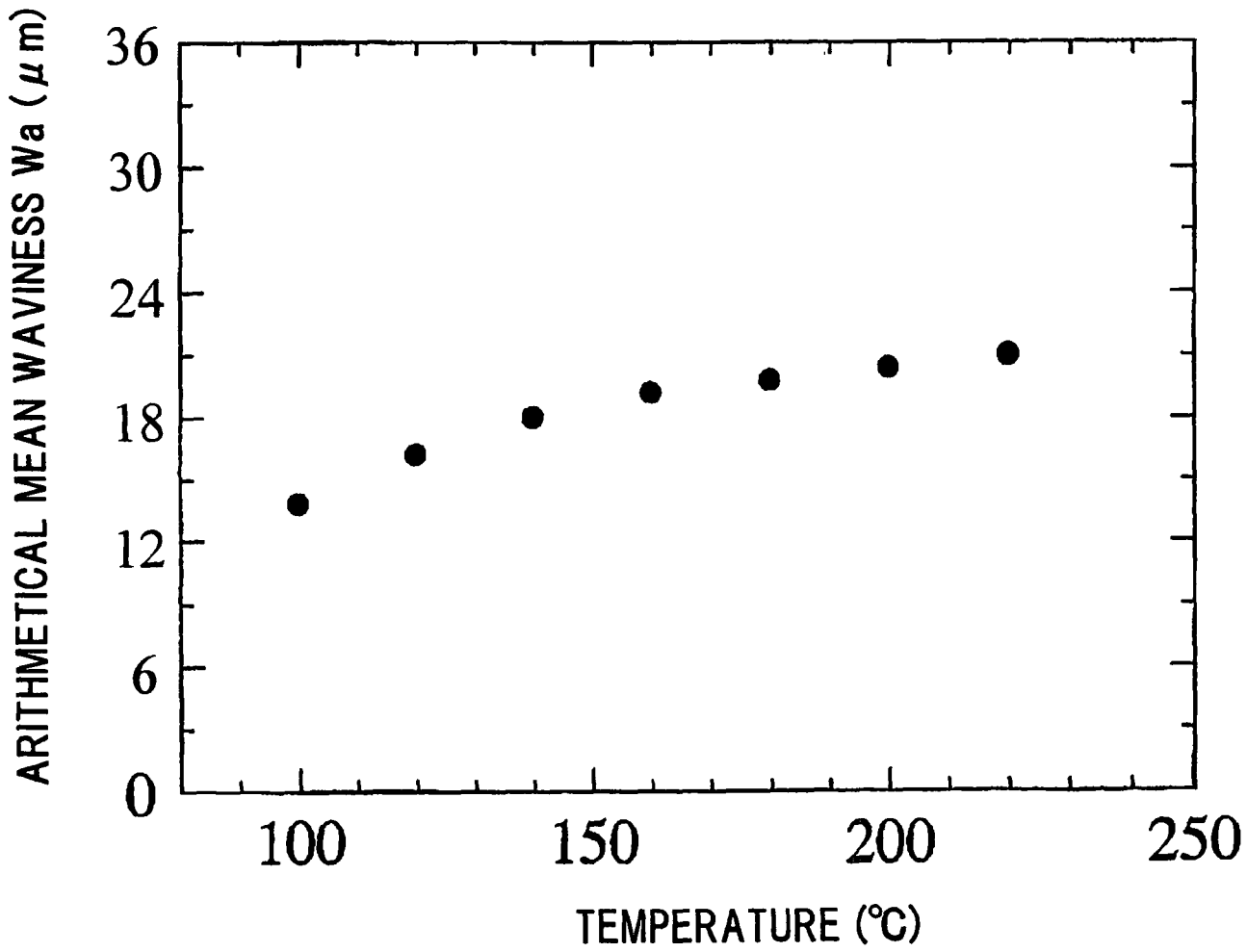
FIG. 4 is a diagram showing a relationship between arithmetical mean waviness (Wa) in cut surface of GaAs wafer and contact portion temperature.

FIG. 4 shows a relationship between arithmetical mean waviness (Wa) in cut surface of GaAs wafer and contact portion temperature.

The arithmetical mean waviness (Wa) in cut surface of GaAs wafer exhibits a tendency to be decreased with decreasing temperature, as in the case of GaN. However, the arithmetical mean waviness (Wa) is not sharply decreased, as in the case of GaN. That is, it has been shown that, unlike the low thermal conductivity compound semiconductors such as GaAs, in the case of the GaN ingot 30, there is an area where arithmetical mean wavinesses (Wa) in cut surface of the GaN wafer resulting from its as-sliced wafer, in other words, the ingot 30 slicing, are sharply decreased by decreasing the temperature of the contact portion 32, and in particular, that the arithmetical mean wavinesses (Wa) can be made very small, by setting the temperature of the contact portion 32 at not more than 140° C.

Example 2

In Example 2, GaN wafers are fabricated from GaN ingots 30, by varying the speed of cutting the GaN ingots 30 in a range of 1 mm/h, 2 mm/h (i.e. the same speed as in Example 1), and 4 mm/h, respectively. The GaN wafers are fabricated in the same manner as in Example 1, and the arithmetical mean wavinesses (Wa) of the resulting GaN wafers are compared. Its results are shown in FIG. 5.

Figure 5:
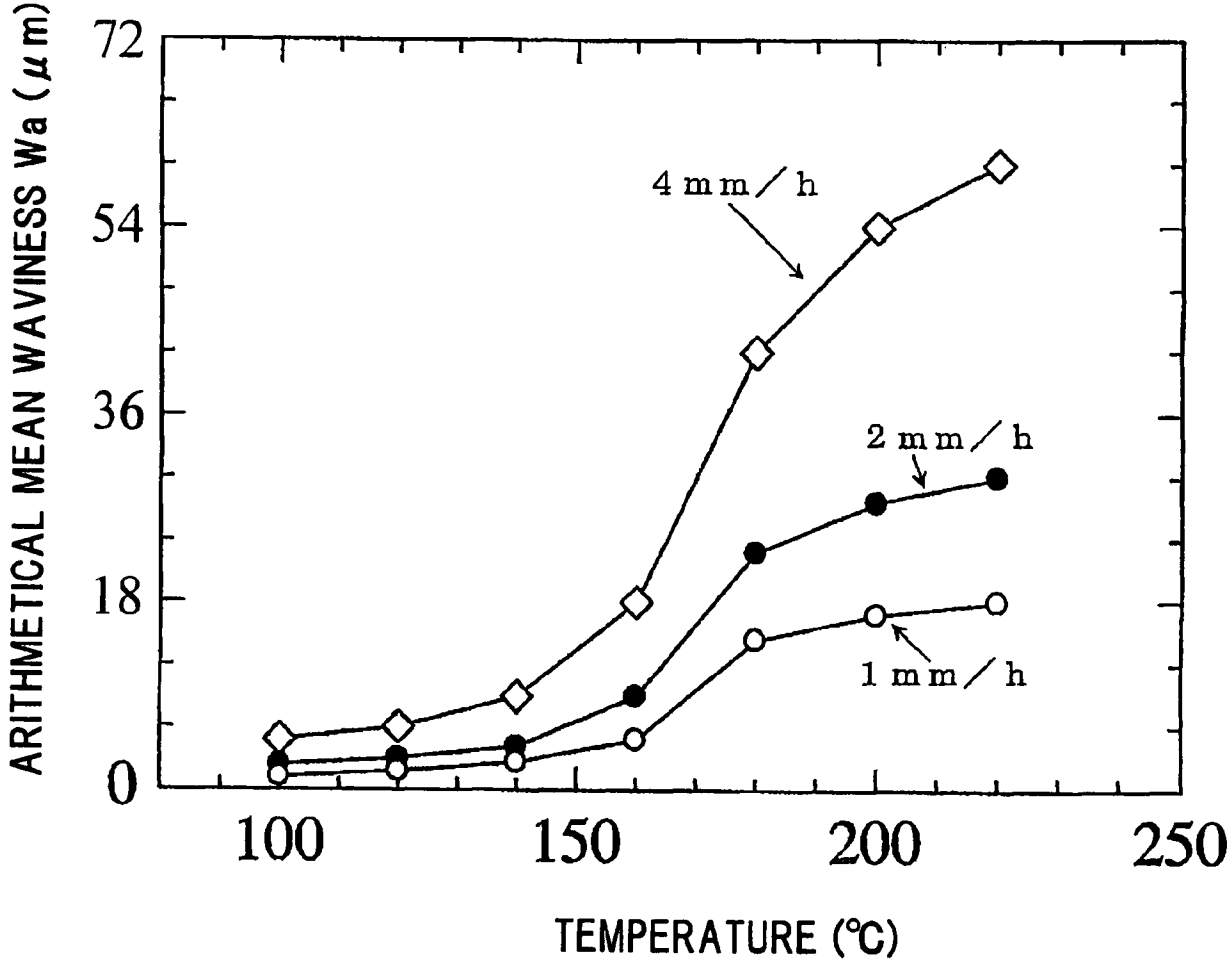
FIG. 5 is a diagram showing relationships between arithmetical mean waviness (Wa) in cut surface of GaN wafer and contact portion temperature, for different cutting speeds, respectively.

FIG. 5 shows relationships between arithmetical mean waviness (Wa) in cut surface of GaN wafer and contact portion temperature, for different cutting speeds, respectively.

As seen from FIG. 5, although the greater the cutting speed, the larger the arithmetical mean waviness (Wa), it is shown that, for all of the cutting speeds, holding the temperature of the contact portion 32 at not more than 160° C. results in the good arithmetical mean wavinesses (Wa) of not more than 18 μm.

Example 3

In Example 3, an AlN single crystal is fabricated from an AlN ingot. Specifically, a 1.5 inchϕ diameter and 20 mm thick AlN single crystal ingot 30 is sliced using a fixed abrasive grain type saw wire 20. Used as the saw wires 20 is a 250 μm wire diameter diamond electrodeposition saw wire. The ingot 30 is then sliced while blasting an aqueous coolant 42 controlled at a constant temperature toward the contact portion 32 between the saw wires 20 and the ingot 30. The wire moving speed of the saw wires 20 is set at 330 m/min, and its cutting speed is set at 2 mm/h. This can result in 21 AlN wafers cut out being approximately 0.6 mm thick.

Here, the temperature of the coolant 42, the circulating speed of the coolant 42, and the position of blasting the coolant 42 to the ingot 30 are adjusted. The temperature of the contact portion 32 between the saw wires 20 and the ingot 30 is varied between from 120° C. to 260° C. The arithmetical mean wavinesses (Wa) of the resulting AlN wafers cut out are compared. The temperature of the contact portion 32 is measured by burying a thermocouple adjacent to the contact portion 32 of the ingot 30 in the same manner as in Example 1.

Figure 6:
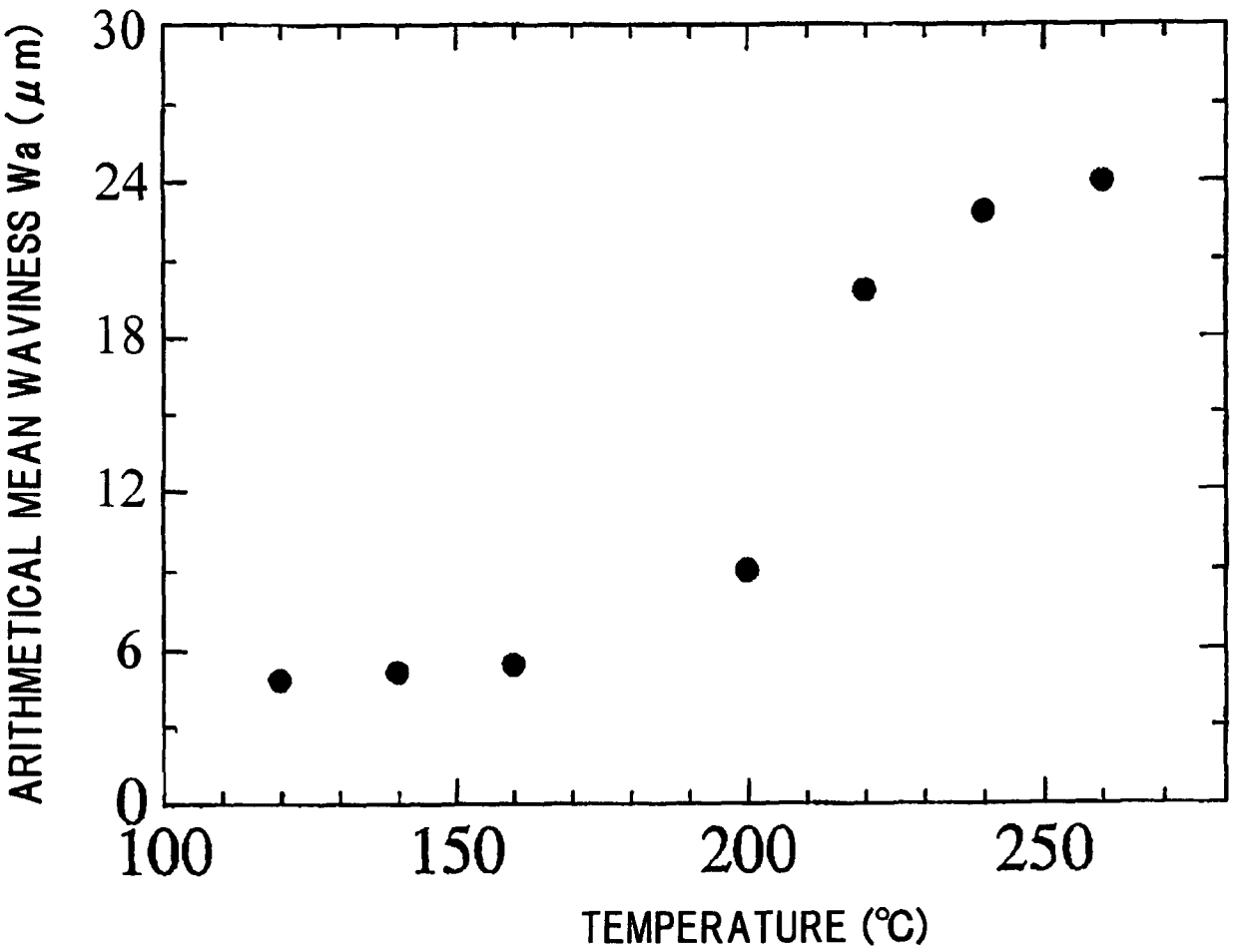
FIG. 6 is a diagram showing a relationship between arithmetical mean waviness (Wa) in cut surface of AlN wafer and contact portion temperature.

FIG. 6 shows a relationship between arithmetical mean waviness (Wa) in cut surface of AlN wafer and contact portion temperature.

The arithmetical mean wavinesses (Wa) in cut surface of AlN wafer are decreased with decreasing temperature of the contact portion 32. Particularly, at a temperature of the contact portion 32 of not more than 220° C., the arithmetical mean waviness (Wa) begins being sharply decreased, and at a temperature of the contact portion 32 of not more than 200° C., the arithmetical mean waviness (Wa) is saturated at not more than 9 μm. That is, the temperatures not less than 120° C. and not more than 200° C. of the contact portion 32 result in the good arithmetical mean wavinesses (Wa) of not more than 9 μm. Accordingly, it has been shown in the same manner as in Example 1, that, in the case of the AlN ingot 30, there is also an area where the arithmetical mean wavinesses (Wa) in its as-sliced wafer are sharply decreased by decreasing the temperature of the contact portion 32, and in particular, that the arithmetical mean wavinesses (Wa) can be made very small to not more than 6 μm, by setting the temperature of the contact portion 32 at not more than 160° C.

Example 4

In Example 4, a SiC single crystal is fabricated from a SiC ingot. Specifically, a 3 inchϕ diameter and 30 mm thick 6H—SiC single crystal ingot 30 is sliced using a fixed abrasive grain type saw wire 20. Used as the saw wires 20 is a 250 μm wire diameter diamond electrodeposition saw wire. The ingot 30 is then sliced while blasting an aqueous coolant 42 controlled at a constant temperature toward the contact portion 32 between the saw wires 20 and the ingot 30. The wire moving speed of the saw wires 20 is set at 330 m/min, and its cutting speed is set at 2 mm/h. This can result in 32 SiC wafers cut out being approximately 0.6 mm thick.

Here, the temperature of the coolant 42, the circulating speed of the coolant 42, and the position of blasting the coolant 42 to the ingot 30 are adjusted. The temperature of the contact portion 32 between the saw wires 20 and the ingot 30 is varied between from 150° C. to 300° C. The arithmetical mean wavinesses (Wa) of the resulting SiC wafers cut out are compared. The temperature of the contact portion 32 is measured by burying a thermocouple adjacent to the contact portion 32 of the ingot 30 in the same manner as in Example 1.

Figure 7:
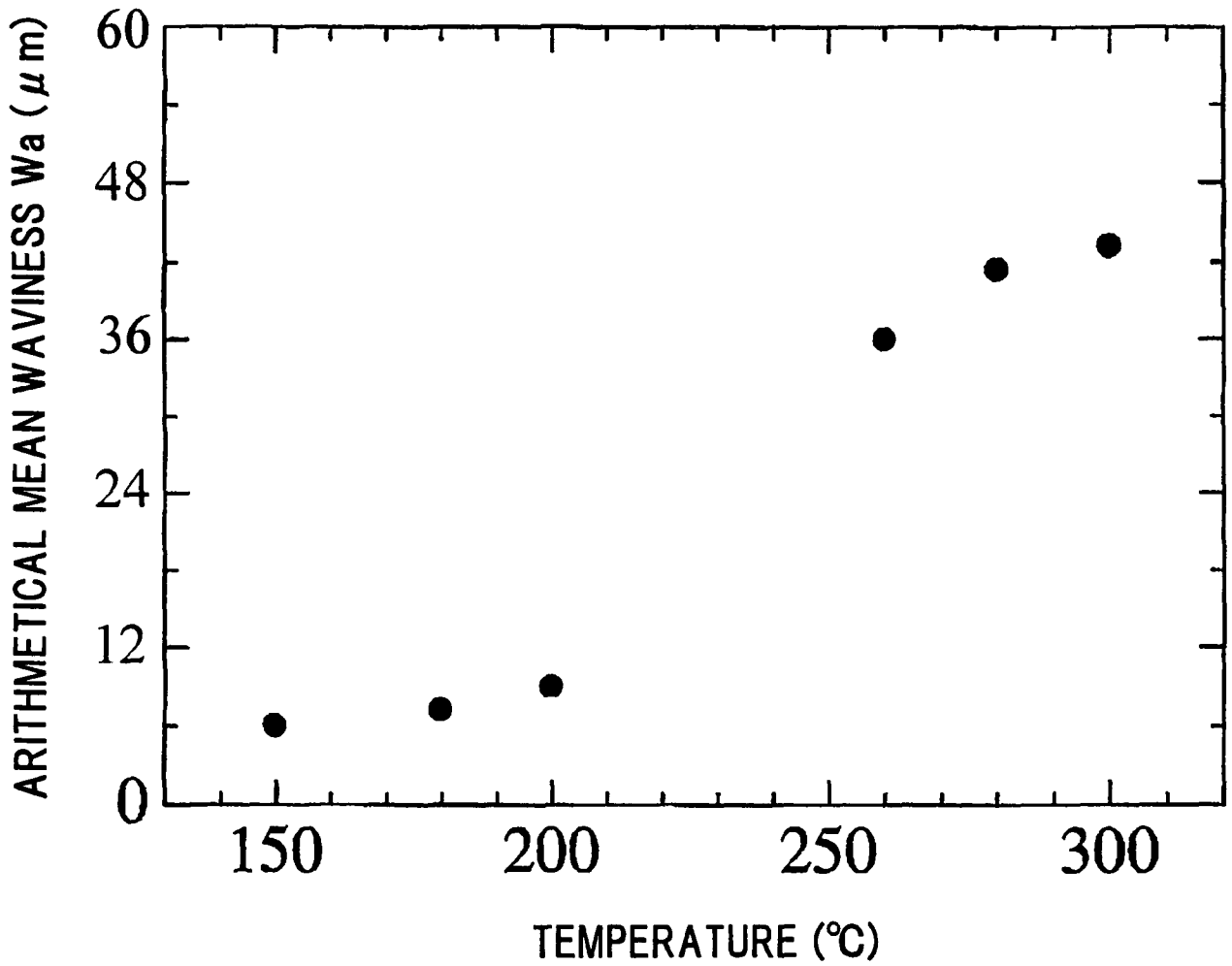
FIG. 7 is a diagram showing a relationship between arithmetical mean waviness (Wa) in cut surface of SiC wafer and contact portion temperature.

FIG. 7 shows a relationship between arithmetical mean waviness (Wa) in cut surface of SiC wafer and contact portion temperature.

The arithmetical mean wavinesses (Wa) in cut surface of SiC wafer are decreased with decreasing temperature of the contact portion 32. Particularly, at a temperature of the contact portion 32 of not more than 240° C., the arithmetical mean waviness (Wa) begins being sharply decreased to not more than 18 μm, and at a temperature of the contact portion 32 of not more than 200° C., the arithmetical mean waviness (Wa) is saturated at less than 12 μm. That is, the temperatures not less than 150° C. and not more than 240° C. of the contact portion 32 result in the good arithmetical mean wavinesses (Wa) of less than 12 μm. Consequently, it has been shown in the same manner as in Examples 1 and 3, that, in the case of the SiC ingot 30, there is also an area where the arithmetical mean wavinesses (Wa) in its as-sliced wafer are sharply decreased by decreasing the temperature of the contact portion 32, and in particular, that the arithmetical mean wavinesses (Wa) can be made very small, by setting the temperature of the contact portion 32 at not more than 200° C.

Although the invention has been described with respect to the above embodiments, the above embodiments are not intended to limit the appended claims. Also, it should be noted that not all the combinations of the features described in the above embodiments are essential to the means for solving the problems of the invention.

What is claimed is:

1. A method of making a compound semiconductor substrate, said method comprising:

providing a GaN compound semiconductor single crystal ingot; and cutting the ingot with a cutter to form a GaN single crystal substrate, wherein the cutting is performed while controlling a temperature in a contact portion between the ingot and the cutter to be not more than 160° C., and wherein a cut surface of said GaN single crystal substrate has an arithmetical mean waviness (Wa) not more than 9 μm.

2. A method of making a compound semiconductor substrate, said method comprising:

providing an AlN compound semiconductor single crystal ingot; and cutting the ingot with a cutter to form an AlN single crystal substrate, wherein the cutting is performed while controlling a temperature in a contact portion between the ingot and the cutter to be not more than 200° C., and wherein a cut surface of said AlN single crystal substrate has an arithmetical mean waviness (Wa) not more than 9 μm.

3. A method of making a compound semiconductor substrate, said method comprising:

providing a SiC compound semiconductor single crystal ingot; and cutting the ingot with a cutter to form a SiC single crystal substrate, wherein the cutting is performed while controlling a temperature in a contact portion between the ingot and the cutter to be not more than 240° C., and wherein a cut surface of said SiC single crystal substrate has an arithmetical mean waviness (Wa) not more than 18 μm.

4. The method according to claim 1, wherein said controlling the temperature is performed by blasting a coolant at the contact portion.

5. The method according to claim 4, further comprising:

setting a temperature of the coolant such that the temperature in the contact portion be not more than 160° C.

6. The method according to claim 1, wherein the temperature in the contact portion between the ingot and the cutter is not more than 140° C.

7. The method according to claim 6, wherein the arithmetical mean waviness of the cut surface of said GaN single crystal substrate is less than 6 μm.

8. The method according to claim 1, wherein the temperature in the contact portion between the ingot and the cutter is not less than 100° C.

9. The method according to claim 3, wherein said controlling the temperature is performed by blasting a coolant at the contact portion.

10. The method according to claim 9, further comprising:

setting a temperature of the coolant such that the temperature in the contact portion be not more than 160° C.

11. The method according to claim 3, wherein the temperature in the contact portion between the ingot and the cutter is not more than 200° C.

12. The method according to claim 11, wherein the arithmetical mean waviness of the cut surface of said SiC single crystal substrate is saturated at less than 12 μm.

13. The method according to claim 3, wherein the temperature in the contact portion between the ingot and the cutter of not less than 150° C. results in the arithmetical mean waviness of the cut surface of said SiC single crystal substrate of less than 12 μm.

* * * * *